US005554261A

United States Patent [19]

Nilz et al.

[11] Patent Number: 5,554,261

[45] Date of Patent: Sep. 10, 1996

[54] DYEING OF PAPER

[75] Inventors: Claudia Nilz, Roedersheim-Gronau; Norbert Sendhoff, Gruenstadt; Walter Breitschaft, Ludwigshafen; Manfred Zillig, Mannheim; Primoz Lorencak, Ludwigshafen, all of Germany

[73] Assignee: BASF Aktiengesellschaft, Ludwigshafen, Germany

[21] Appl. No.: 397,060

[22] PCT Filed: Sep. 23, 1993

[86] PCT No.: PCT/EP93/02580

§ 371 Date: Mar. 15, 1995

§ 102(e) Date: Mar. 15, 1995

[87] PCT Pub. No.: WO94/08092

PCT Pub. Date: Apr. 14, 1994

[30] Foreign Application Priority Data

Oct. 1, 1992 [DE] Germany ..... 42 22 040.8

[51] Int. Cl.[6] ..... D21H 21/28

[52] U.S. Cl. ..... 162/162; 162/148; 162/168.2; 162/181.1

[58] Field of Search ..... 162/162, 168.2, 162/164.6, 148, 181, 150

[56] References Cited

U.S. PATENT DOCUMENTS

| | | | |
|---|---|---|---|
| 4,421,602 | 12/1983 | Brunmueller et al. | 162/168.2 |

FOREIGN PATENT DOCUMENTS

| | | | |
|---|---|---|---|
| 686202 | 5/1964 | Canada | 162/162 |
| 061173 | 9/1982 | European Pat. Off. . | |
| 216387 | 4/1987 | European Pat. Off. . | |
| 309908 | 4/1989 | European Pat. Off. . | |
| 438707 | 7/1991 | European Pat. Off. . | |
| 4007312 | 9/1991 | Germany . | |

*Primary Examiner*—Peter Chin

*Attorney, Agent, or Firm*—Oblon, Spivak, McClelland, Maier & Neustadt, P.C.

[57] ABSTRACT

A process for dyeing paper in connection with paper manufacture by adding water-soluble anionic dyes and cationic polymers which contain vinylamine units to the paper pulp as fixing agents and removing water from the paper pulp with the formation of dyed paper is described.

9 Claims, No Drawings

DYEING OF PAPER

The present invention relates to a process for dyeing paper during paper manufacture by adding water-soluble anionic dyes and cationic polymers to the paper pulp as fixing agents and removing water from the paper pulp with the formation of dyed paper.

EP-A-0 061 173 discloses a process for dyeing paper using water-soluble acidic dyes and/or direct dyes in aqueous medium in the presence of cationic auxiliaries. The dyeing of the paper in this process is preferably carried out in bulk, ie. during manufacture of the paper. The cationic auxiliaries used here are water-soluble reaction products which are obtainable by reaction of alkylating agents which contain an aromatic substituent with cationic polyelectrolytes. Suitable auxiliaries of this type are, for example, benzylated polyethyleneimines. The known strongly cationic polymers have the disadvantage that they very greatly dull the brilliance of the dyed paper. Condensates of dicyandiamide and formaldehyde or condensates of urea and formaldehyde are therefore mainly used in practice as fixing agents for water-soluble anionic dyes in the dyeing of paper. The condensates have the disadvantage that they contain a certain amount of free formaldehyde.

EP-A-0 309 908 discloses a process for dyeing paper in bulk using pigments and fixing agents, in which pigments and fixing agents are added simultaneously to the paper pulp to be dyed and various classes of cationic polymers are used as fixing agents, for example polymers of diallyldimethylammonium chlorides, polymers of N-vinylimidazoles, polymers of N-vinylimidazolines, copolymers containing vinylamine units and copolymers of acrylamide with dialkylaminoalkyl acrylates and/or methacrylates.

U.S. Pat. No. 4,421,602 discloses partially hydrolyzed homopolymers of N-vinylformamide which contain N-vinylformamide and vinylamine units. They are used as retention, dehydrating and flocculating agents in the manufacture of paper. EP-A-0 216 387 additionally discloses the addition of copolymers of 95–10 mol % of N-vinylformamide and 5–90 mol % of an ethylenically unsaturated monomer from the group consisting of vinyl acetate, vinyl propionate, the $C_1$- to $C_4$-alkyl vinyl ethers, N-vinylpyrrolidone, and the esters, nitriles and amides of acrylic acid and methacrylic acid in at least partially hydrolyzed form in which up to 100 mol % of the formyl groups are removed from the copolymer, in amounts of 0.1–5% by weight, based on dry fibers, to the paper pulp before sheet formation as a wet- and dry-consolidation agent for paper.

The use of hydrolysed homo- and/or copolymers of N-vinylformamide with a degree of hydrolysis of at least 60% of the copolymerized N-vinylformamide units as a fixing agent in combination with a cationic retention agent in the manufacture of paper, cardboard and (paperboard) by removal of water from a paper pulp containing interfering substances is additionally disclosed in EP-A-0 438 707.

It is an object of the present invention to make available a process for dyeing paper in which the dyeing is carried out in bulk during the paper-manufacturing process using water-soluble anionic dyes and cationic formaldehyde-free polymers as fixing agents, dyed paper with high light-fastness and a low dulling of the brilliance being obtained.

We have found that this object is achieved by a process for dyeing paper during paper manufacture by adding water-soluble anionic dyes and cationic polymers to the paper bulk as fixing agents and removing water from the paper pulp with the formation of dyed paper, if polymers containing vinylamine units are employed as cationic polymers.

The paper is dyed during paper manufacture by the process according to the invention. For this purpose, water-soluble anionic dyes and specially selected cationic polymers are added to the paper pulp. Compared with other known fixing agents, dyed paper which has a high light-fastness and in which the brilliance is only slightly dulled is obtained by the process according to the invention.

Suitable water-soluble anionic dyes for dyeing paper in bulk are known and commercially available. These dyes are, for example, mono- or polyazo dyes which each have at least one sulfonic acid group, sulfonic acid-bearing triarylmethane dyes, copper phthalocyanine-sulfonic acids, sulfonic acid-containing quinoline dyes or stilbene dyes. Direct Yellow 4 (C.I. 24890), Direct Yellow 5 (C.I. 47035), Direct Yellow 11 (C.I. 40,000), Direct Yellow 50 (C.I. 29025), Direct Yellow 127, Direct Yellow 132, Direct Yellow 147, Direct Yellow 153, Acid Orange 7 (C.I. 15510), Acid Orange 8 (C.I. 15575), Direct Orange 15 (C.I. 40003), Direct Orange 34 (C.I. 40215), Direct Orange 102 (C.I. 29156), Direct Red 81 (C.I. 28160), Direct Red 239, Direct Red 252–255, Direct Violet 9 (C.I. 27855), Direct Violet 51 (C.I. 27905), Acid Blue 9 (C.I. 42090), Direct Blue 86 (C.I. 74180), Direct Blue 199 (C.I. 74190), Direct Blue 218 (C.I. 24401), Direct Blue 267, Direct Blue 273, Direct Blue 279, Direct Blue 281, Acid Black 194, Acid Black 208, Acid Black 210, Acid Black 221, Direct Black 19 (C.I. 35255), Direct Black 161, Direct Black 170 or Direct Black 171 may be mentioned by way of example.

The dyes are employed, for example, in amounts of 0.01–10, preferably 0.1–5, % by weight, based on dry fiber substance.

According to the invention, polymers containing vinylamine units are employed as fixing agents. In this case, these can be, for example, hydrolyzed homopolymers of N-vinylformamide which contain a) 0.1–100 mol % of vinylamine units b) 99.9–0 mol % of vinylformamide units.

However, hydrolyzed copolymers of N-vinylcarboxamides can also be employed which are obtainable by copolymerizing (1) 1–99 mol % of N-vinylcarboxamides and (2) 99–1 mol % of acid-free monoethylenically unsaturated monomers and subsequently hydrolyzing 0.1–100 mol % of the copolymerized N-vinylcarboxamides with the formation of vinylamine units.

Suitable monomers of the group (1) are N-vinylcarboxamides of the formula

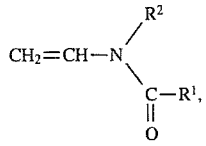

(1)

in which $R^1$ and $R^2$ are H or $C_1$- to $C_6$-alkyl. Suitable monomers are, for example, N-vinylformamide, N-vinyl-N-methylformamide, N-vinylacetamide, N-vinyl-N-methylacetamide, N-vinyl-N-ethylacetamide, N-vinyl-N-methylpropionamide and N-vinylpropionamide. Said monomers can either be employed alone or in a mixture with one another for preparing the copolymers. N-Vinylformamide is preferably used from this group of monomers. The copolymers contain the monomers of the group (1) in amounts from 1–99, preferably 10–40, mol % in copolymerized form.

The use is preferred of hydrolyzed copolymers of N-vinylformamide which are obtainable by copolymerizing (1) 1–99 mol % of N-vinylformamide and (2) 99–1 mol % of at least one monomer from the group consisting of vinyl acetate, vinyl propionate, vinylurea, $C_1$- to $C_4$-alkyl vinyl ether, N-vinylpyrrolidone, and the esters, nitriles and amides of acrylic acid or methacrylic acid and hydrolyzing the copolymers obtainable in this way such that 0.1–100 mol % of the copolymerized N-vinylformamide is hydrolyzed. The monomers of the group (2) incorporated in the copolymer remain virtually unchanged during this hydrolysis. The hydrolysis of the copolymer containing vinylformamide in copolymerized form can also be carried out, however, by hydrolyzing the comonomers copolymerized in the copolymer. Such hydrolyzed copolymers are obtainable, for example, by copolymerizing (1) 1–99 mol % of N-vinylformamide and (2) 99–1 mol % of vinyl acetate and/or vinyl propionate and subsequently hydrolyzing 40–100 mol % of the copolymerized N-vinylformamide units and hydrolyzing 50–100 mol % of the acetyl or propionyl groups of the copolymerized monomers (2). Copolymers are preferably used which contain 40–80 mol % of vinylamine units and 60–20 mol % of vinyl alcohol, acrylonitrile and/or vinylurea units in copolymerized form. Such copolymers can if desired still contain vinylformamide units or vinyl acetate and/or vinyl propionate units. The preparation of such polymers is disclosed, for example, in EP-A-0 216 387. Mineral acids, such as hydrogen halides, which can be employed in gas form or in aqueous solution are especially useful as hydrolysis agents. Hydrochloric acid, sulfuric acid, nitric acid and phosphoric acid as well as organic acids, such as $C_1$- to $C_5$-carboxylic acids and aliphatic or aromatic sulfonic acids, are preferably used. The pH during the acidic hydrolysis is –1–5, preferably 0–2. 0.05–2, preferably 1–1.5, molar equivalents of an acid are required per formyl equivalent which is to be removed from the copolymerized vinylcarboxamide units.

The hydrolysis of the formyl groups contained in the polymers can also be carried out with the aid of bases, for example of metal hydroxides, in particular of alkali metal and alkaline earth metal hydroxides. Sodium hydroxide or potassium hydroxide is preferably used.

The hydrolysis is preferably carried out in aqueous solution or suspension at reaction temperatures from 20° to 100° C. Following a hydrolysis carried out under acidic conditions, the reaction mixture may be neutralized with bases, preferably sodium hydroxide solution. If the hydrolysis is carried out using bases, the reaction mixture may be neutralized by adding acids, preferably hydrochloric acid. The vinylamine units a) are then present in salt form. The K value of the hydrolyzed copolymers is 30–200, preferably 30–80 (determined according to H. Fikentscher in 1% strength aqueous sodium chloride solution at 25° C., a polymer concentration of 1% by weight and pH 7).

The cationic polymers described above are used as fixing agents for water-soluble anionic dyes and are added to the paper pulp, for example, in amounts of 0.1–5, preferably 0.1–0.5, % by weight, based on the dry solids in the pulp.

Suitable fiber materials for producing the pulps are all grades which can be used for this purpose, for example wood pulp, bleached and unbleached pulp as well as paper pulps from all annual plants. The wood pulps include, for example, ground wood, thermomechanical pulp (TMP), chemo-thermomechanical pulp (CTMP), pressure-ground wood, semichemical pulp, high-yield pulp and refiner mechanical pulp (RMP). Suitable pulps are, for example, sulfate, sulfite and soda pulps. Suitable annual plants for producing paper pulps are, for example, rice, wheat, sugar cane and kenaf. Waste paper is also used to produce the pulps, either on its own or mixed with other fiber materials. In addition, inorganic fillers such as kaolin, chalk, titanium dioxide or talc and, if desired, customary auxiliaries in paper manufacture such as aluminum sulfate, retention agents or sizing agents can also be added to the paper pulps to be dyed, if required. The pH of the pulp suspension can be 4–9.

In order to obtain brilliant dyeings having high lightfastness, the dye can first be added to the paper pulp and, after homogenizing, the fixing agent can be added or the fixing agent can be added first and the water-soluble anionic dye or a dye mixture can be added afterwards.

The K values of the copolymers were determined according to H. Fikentscher, Cellulose Chemie [Cellulose Chemistry], volume 13, (1932) 48–64 and 71–74 in 5% strength aqueous sodium chloride solution at 25° C. and a polymer concentration of 1% by weight and pH 7. The percentage data in the examples are percentages by weight, if not stated otherwise.

EXAMPLES

The following cationic polymers were tested as fixing agents:

Polymer 1:

a commercially available condensate of dicyandiamide, urea and formaldehyde (comparison).

Polymer 2:

a commercially available condensate of dicyandiamide and formaldehyde (comparison).

Polymer 3:

copolymer of 70 mol % of vinylamine and 30 mol % of vinyl alcohol, K value 60.

Polymer 4:

copolymer of 60 mol % of vinylamine and 40 mol % of acrylonitrile, K value 60.

Polymer 5:

a copolymer of 80 mol % of vinylamine and 20 mol % of vinyl urea, K value 30.

Polymer 6:

a copolymer of 50 mol % of vinylamine and 50 mol % of vinyl urea, K value 30.

Example 1

A mixture of 70 % bleached pine kraft pulp and 30% bleached birchwood kraft pulp was used as the pulp model. The pulp was 4% strength and was beaten to a degree of beating of 30° SR (SR=Schopper-Riegler). Aliquots which corresponded to 5 g of dry pulp were taken from this, and fixing agent and either 2% (based on dry pulp) of a liquid formulation of C.I. Direct Red 254 or 10% of a liquid formulation of Acid Orange 7 (C.I. 5510) was added. After sheet-forming on a rapid Köthen sheet former, the color strengths of the paper sheets were determined colorimetrically by means of an Elrepho 2000.

The following results were obtained

TABLE 1

| | | Amount added (% solid) Fixing Agent | Direct Red 254 Relative color strength (%) of the dyed paper Polymer 1 = 100% | Acid Orange 7 (C.I. 15510) Relative color strength (%) of the dyed paper Polymer 1 = 100% |
|---|---|---|---|---|
| Comparison Example | Polymer 1 | 0.27 | 100 | 100 |
| Comparison Example | Polymer 2 | 0.30 | 115 | 140 |
| Example | Polymer 3 | 0.12 | 110 | 170 |
| Example | Polymer 4 | 0.09 | 97 | 175 |
| Example | Polymer 5 | 0.11 | 95 | 145 |
| Example | Polymer 6 | 0.14 | 110 | 220 |
| Comparison Example | Without addition of a polymer | 0 | 80 | 20 |

Example 2

Paper was manufactured in the neutral pH range on a paper machine from a wood-free, sized pulp containing chalk as the filler. The pulp composition was:

65% of bleached beechwood sulfite pulp

35% of bleached pine kraft pulp

20% of industrial chalk DX 1

1.1% of promoter-free fatty alkyldiketene sizing agent 0.02% of cationic polyacrylamide as retention agent The amounts of fixing agents given in the following tables, based on dry paper pulp, and 2% liquid formulations of dyes were in each case added to this paper pulp.

The following dyes were selected:

Direct Yellow 11 (C.I. 40,000), Acid Orange 7 (C.I. 15510) and Direct Blue 86 (C.I. 74180).

The results are summarized in the following tables.

2.1 Relative color strength (%), without fixing agent = 100%

| Dye | Addition (% solid) Fixing Agent | Dye of Color Index No. 40000 | No. 15510 | No. 74180 |
|---|---|---|---|---|
| Without fixing agent | 0 | 100 | 100 | 100 |
| Polymer 1 (Comparison) | 0.45 | 95 | 200 | 320 |
| Polymer 2 (Comparison) | 0.49 | 90 | 240 | 320 |
| Polymer 3 (according to the invention) | 0.18 | 100 | 250 | 320 |

2.2 Two-sidedness (% color strength top to wire side)

| Dye | Addition (% solid) Fixing Agent | Dye of Color Index No. 40000 | No. 15510 | No. 74180 |
|---|---|---|---|---|
| Without fixing agent | 0 | 100 | 82 | 90 |
| Polymer 1 (Comparison) | 0.45 | 102 | 94 | 103 |
| Polymer 2 (Comparison) | 0.49 | 95 | 105 | 102 |
| Polymer 3 (according to the invention) | 0.18 | 105 | 97 | 101 |

2.3 Dye in waste water (mg/l)

| Dye | Addition (% solid) Fixing Agent | Dye of Color Index No. 40000 | No. 15510 | No. 74180 |
|---|---|---|---|---|
| Without fixing agent | 0 | 10 | 18 | 15 |
| Polymer 1 (Comparison) | 0.45 | 2 | 13 | 2 |
| Polymer 2 (Comparison) | 0.49 | 2 | 10 | 0.5 |
| Polymer 3 (according to the invention) | 0.18 | 2 | 12.5 | 1 |

2.4 Light-fastness (according to DIN 54 004)

| Dye | Addition (% solid) Fixing Agent | Dye of Color Index No. 40000 | No. 15510 | No. 74180 |
|---|---|---|---|---|
| Without fixing agent | 0 | 2 | 1–2 | 4 |
| Polymer 1 (Comparison) | 0.45 | 2 | 1–2 | 4 |
| Polymer 2 (Comparison) | 0.49 | 2 | 1–2 | 3 |
| Polymer 3 (according to the invention) | 0.18 | 2 | 1–2 | 4 |

We claim:

1. A process for dyeing paper during paper manufacture by adding water-soluble anionic dyes and cationic polymers to a paper pulp as fixing agents in an amount sufficient to fix said dyes and removing water from said paper pulp with the formation of dyed paper, said cationic polymers comprising hydrolyzed copolymers of N-vinylcarboxamides which comprise:

a) 40–80 mol % of vinylamine units; and b) 60–20 mol % of units of vinyl alcohol, acrylonitrile, vinylurea and a mixture thereof, in copolymerized form.

2. The process of claim 1, wherein said cationic polymer further comprises units selected from the group consisting of vinylformamide, vinylacetate, vinylpropionate and a mixture thereof.

3. The process of claim 1, wherein said paper pulp is selected from the group consisting of wood pulp, bleached pulp, unbleached pulp, paper pulp and a mixture thereof.

4. The process of claim 1, wherein said pulp is a wood pulp selected from the group consisting of ground wood, thermomechanical pulp, chemo-thermomechanical pulp, pressure-ground wood, semichemical pulp, high-yield pulp, refiner mechanical pulp and a mixture thereof.

5. The process of claim 1, wherein said pulp is a bleached or unbleached pulp, wherein said pulp is selected from the group consisting of sulfate pulp, sulfite pulp, soda pulp and a mixture thereof.

6. The process of claim 1, wherein said pulp is a paper pulp from an annual plant, wherein said plant is selected from the group consisting of rice, wheat, sugar cane, kenaf and a mixture thereof.

7. The process claim 1, wherein said paper pulp further comprises an inorganic filler selected from the group consisting of kaolin, chalk, titanium dioxide, talc and a mixture thereof.

8. The process of claim 1, wherein said cationic polymer is present in an amount of 0.1–5% by weight, based on the dry solids in said pulp.

9. The process of claim 1, wherein said hydrolyzed copolymer has a K value of from 30–200.

* * * * *

UNITED STATES PATENT AND TRADEMARK OFFICE

CERTIFICATE OF CORRECTION

PATENT NO. : 5,554,261

DATED : September 10, 1996

INVENTOR(S) : Claudia NILZ, et al.

It is certified that error appears in the above-indentified patent and that said Letters Patent is hereby corrected as shown below:

On the title page, Item [30], the Foreign Application Priority Data, should read:

--[30] Foreign Application Priority Data

Oct. 1, 1992 [DE] Germany.....42 33 040.8--

Signed and Sealed this

Twenty-sixth Day of November 1996

*Attest:*

Bruce Lehman

BRUCE LEHMAN

*Attesting Officer*

*Commissioner of Patents and Trademarks*